United States Patent [19]

Wentworth

[11] 4,142,062

[45] Feb. 27, 1979

[54] MATERIAL HEATING FURNACE AND HEATING ELEMENT

[75] Inventor: Hobart L. Wentworth, Barrington, Ill.

[73] Assignee: Sola Basic Industries, Inc., Milwaukee, Wis.

[21] Appl. No.: 775,154

[22] Filed: Mar. 7, 1977

Related U.S. Application Data

[63] Continuation of Ser. No. 627,369, Oct. 30, 1975, abandoned.

[51] Int. Cl.[2] ..... H05B 3/06; H05B 3/20

[52] U.S. Cl. ..... 13/25; 219/552; 338/289; 338/279

[58] Field of Search ..... 13/20, 25, 22; 338/280, 338/289, 293, 233, 279; 219/357, 345, 542, 552

[56] References Cited

U.S. PATENT DOCUMENTS

| | | | |
|---|---|---|---|
| 2,820,076 | 1/1958 | Lillienberg | 338/329 X |
| 2,896,004 | 7/1959 | Duffy et al. | 13/25 |

*Primary Examiner*—R. N. Envall, Jr.

*Attorney, Agent, or Firm*—Parmelee, Johnson, Bollinger & Bramblett

[57] ABSTRACT

A material heating furnace with a heating element formed of corrugated metal strips which are spaced at one of the ends thereof by a jumper strip which is welded or otherwise fastened to the metal strips. Also, terminals are provided which are slotted so as to alleviate stresses due to bending.

8 Claims, 9 Drawing Figures

FIG. 1
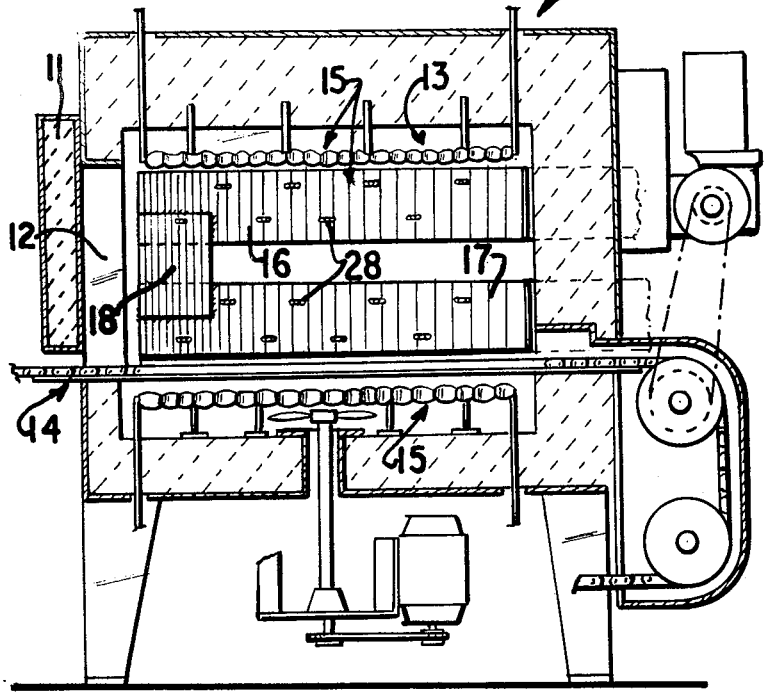
FIG. 5
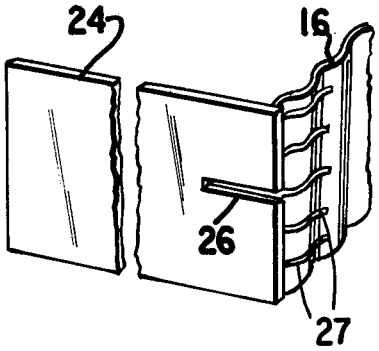
FIG. 3
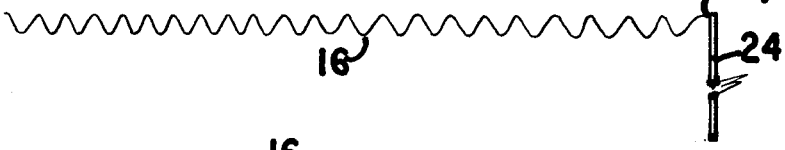
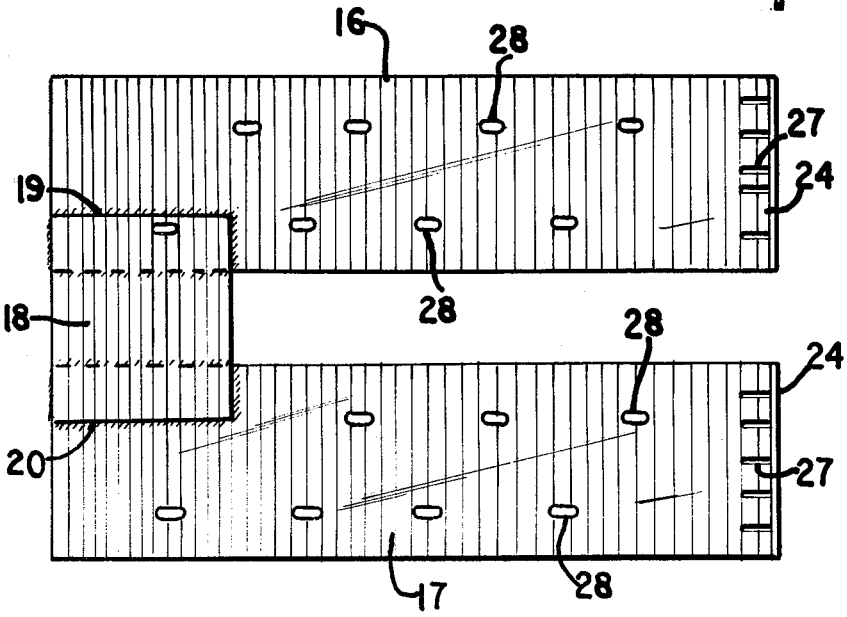
FIG. 2
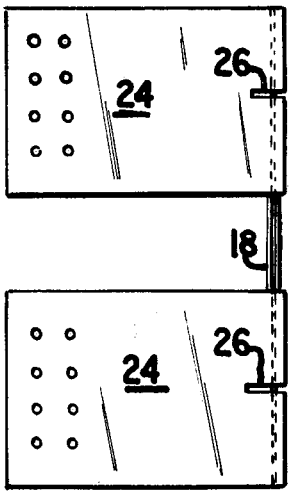
FIG. 4

FIG. 7
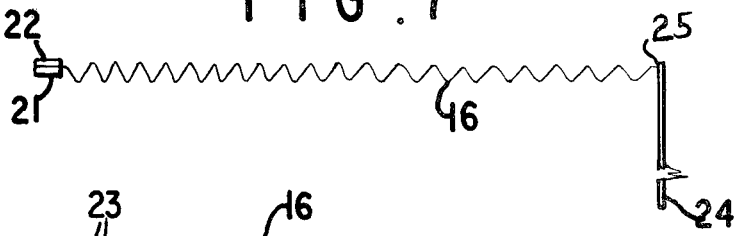
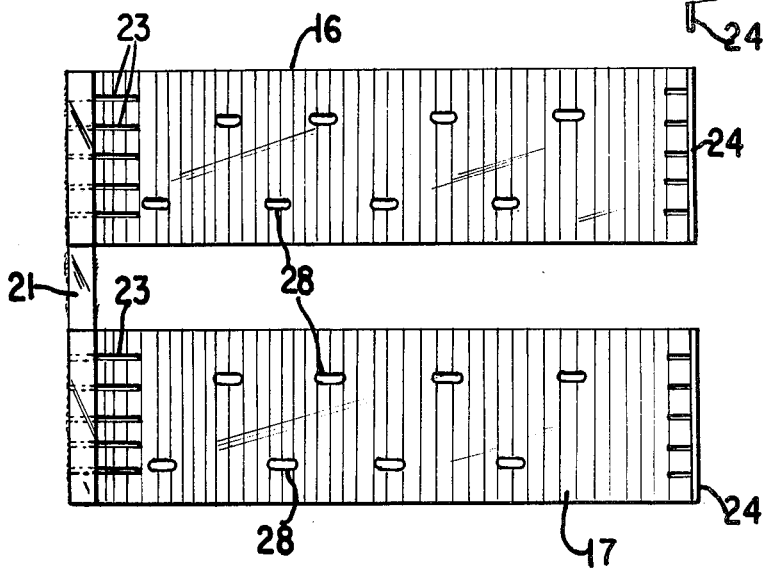
FIG. 6
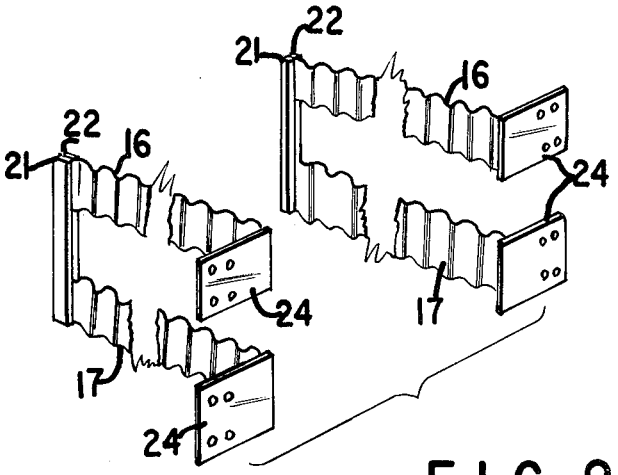
FIG. 8
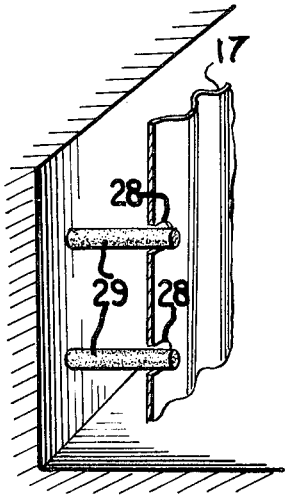
FIG. 9

MATERIAL HEATING FURNACE AND HEATING ELEMENT

This application is a continuation of prior copending application Ser. No. 627,369, filed Oct. 30, 1975, and now abandoned.

This invention relates to electric material heating furnaces and especially to the resistance heating elements used therein.

Various types of strip resistance heating elements have been used in the past, such as shown, for example, in U.S. Pat. Nos. 2,820,076; 2,891,303; and 2,896,004. The fabrication of the elements and particularly the spacing of the parts thereof has been difficult in some instances. Also, the problem of expansion of the elements in relation to the furnace and to themselves has caused difficulties.

One of the objects of the invention is to provide an improved electric heating furnace.

Another of the objects of the invention is to provide improved heating elements for an electric material heating furnace.

Another of the objects of the invention is to provide an improved heating element construction.

In one aspect of the invention, the furnace has a chamber into which material to be heated is placed, the chamber being closed at one end. A pair of spaced heating resistance strips are joined at one of their ends by jumper strip means, the jumper strip means being joined to the spaced strips by welding or similar joining which must be such as to withstand high temperatures. In one form, the jumper strip means can be corrugated to match the corrugations of the spaced strips. The jumper strip also could comprise a pair of strips with the ends of the spaced strips sandwiched therebetween. Also, the terminals can have a slot which matches a slot in the end of a space strip where joined so as to alleviate bending problems.

Other objects, advantages and features of the present invention will become apparent from the accompanying description and drawings, which are merely exemplary.

In the drawings:

FIG. 1 shows a vertical section through one type of furnace with which the arrangement can be used;

FIG. 2 is a side view of one form of heating element;

FIG. 3 is a top view of FIG. 2;

FIG. 4 is an end view of FIG. 2 showing the terminal arrangement;

FIG. 5 is a fragmentary perspective view of a terminal and strip;

FIG. 6 is a side view showing another form of element strip;

FIG. 7 is a top view of FIG. 6;

FIG. 8 is a perspective view of two of the heating elements of FIG. 6; and FIG. 9 is a perspective view showing the manner in which the elements can be hung on the wall of the furnace.

Where appropriate, like reference numerals will indicate the same parts in the various figures.

One type of furnace to which the invention can be applied is illustrated in FIG. 1, it being understood that the heating elements can be used in various types of electrical material heating furnaces. The electric heating furnace generally indicated at 10 may have a slidable door 11 closing the front opening 12 of the furnace. Chamber 13 within the furnace has rear, side, bottom and top walls. The walls are made of suitable refractory.

A conveyor arrangement 14 of any suitable type can be used to transport the material to and from the furnace. It also is possible to use the heating elements of the invention with a pass through furnace.

The furnace chamber is heated by the electric resistance heating elements of the present invention, shown generally at 15. The heating elements may be along each side of the chamber and also at the top and bottom as illustrated. The elements are spaced from the side walls.

Referring to the heating element of FIGS. 2 and 3, the elongated spaced heating strips 16, 17 are corrugated and are held in spaced relation by the mating corrugated jumper strip 18. The corrugations are transverse of the longitudinal axis of a strip. The jumper strip or connector is welded at 19, 20 to strips 16 and 17, respectively. By using a welded jumper strip, having corrugations mating or complementary to those of the spaced longitudinal strips, an improved weld bonded strip arrangement is obtained. Also, it is relatively simple to join the strips at the spaced distance desired and without waste of material, in contrast to where the corrugated strip is integral with spaced strips.

An increased radiating surface is provided at the charge end of the furnace. The jumper strip or connector is of the same material as the strips and, thus, will expand in the same relation. The connector also preferably is of the same cross section as the element sheet.

An alternative form of jumper strip or bar connector is shown in FIGS. 6 and 7. The jumper connector elements 21, 22 have the ends of the spaced strips 16, 17 sandwiched therebetween. The parts are joined together by welding.

The sandwich type of bar connector or strip is particularly useful for a heavy duty type of cycling and heavy gas carburizing. The cross sectional area, for example, can be increased from the previous 3.75 sq. in. to 5.0 sq. in. so that the chance of warpage is reduced by decreasing resistance to current flow.

The saw slots 23 in the spaced strips have been made of such a length to allow the metal to expand but to keep the expansion stresses from acting on the jumper bar strip which will decrease the stresses on the welded bond.

At the other end of spaced strips 16 and 17, terminals 24 are welded at 25 (FIG. 3) to their respective spaced strips 16 and 17. The terminals 24 are arranged so that they can extend through the walls of the furnace for electric connections thereto.

The terminal has a slot 26 cut therein to match the middle slot 27 at the ends of the spaced strips. This allows the terminal to bend without rupturing the welded bond between the element sheet and the terminal. The terminals are arranged so as to pass in the proper direction or the desired direction through the walls of the furnace.

As is known in the art, the spaced strips can have apertures 28 (FIGS. 2, 6 and 9) therein for receiving support rods 29 in the walls of the furnace. By placing the support holes or apertures sufficiently low, the bottom of the element assembly or spaced strip 17 can be raised above the fire brick support piers so as to alleviate stress in the fire brick at this point.

In order to protect the terminal from exposure to carbon, which precipitates in the fire brick insulation during a typical carburizing heat treatment, the portion of the terminal which projects through the fire brick insulation can be enameled. The enamel is a dielectric which inhibits attack of the atomsphere on the terminal. The pitch of the corrugations can be decreased as the jumper end is approached. Also, a corrugated jumper strip, as seen in FIG. 2, can be placed on the other side of the spaced strips in a sandwich construction similar to FIG. 6.

The spaced resistance strips and parts can be made of a suitable electrical resistance metal. A metal such as "Inconel 601," a trademark of The International Nickel Company, Inc., can be used.

It should be apparent that variations may be made in construction and arrangement of parts without departing from the spirit of the invention except as defined in the appended claims.

What is claimed is:

1. In an electric heating furnace including a hollow body having walls of refractory material defining a chamber for receiving material to be heated therein and wherein a heating element includes an elongated heating strip of electrically conductive resistance material, said strip having width and being many times wider than its thickness for providing a heat radiating surface, said strip having corrugations therein extending transversely of the length of the strip and being mounted in the chamber spaced from a wall thereof with its heat radiation surface facing into the chamber and including a flat connector strip secured to an end of said heating strip and extending at right angle to the length of said heating strip for conducting electrical current to said heating strip, an improved heating element in which:

said corrugated heating strip having a plurality of spaced parallel slots cut therein, each slot extending from the end of the heating strip in a direction lengthwise of the strip and perpendicular to the currugations, said slots each having a length which is many times greater than the thickness of said heating strip and extending partially along the length of said heating strip thereby separating the end of the heating strip into a plurality of spaced parallel corrugated portions, and said connector strip being welded to the end of each of said spaced parallel corrugated portions of said heating strip, whereby stresses are decreased on the welded connection between said connector strip and the heating strip which would otherwise arise from thermal expansion of the heating strip relative to the connector strip.

2. In an electric heating furnace, an improved heating element as claimed in claim 1, in which:

said connector strip is a jumper strip which extends transversely across the ends of said parallel corrugated portions of the heating strip to which said jumper strip is welded and extends over and is welded to another similar heating strip for conducting electrical current between said heating strips, and said spaced parallel slots in the end of said heating strip extend perpendicular to the length of said jumper strip.

3. In an electric heating furnace, an improved heating element as claimed in claim 1, in which said connector strip is a terminal strip has a width comparable to the width of said corrugated heating strip, said terminal strip extends from the ends of said parallel corrugated portions of the heating strip to which said terminal strip is welded and extends in a direction generally perpendicular to the radiating surface of said heating strip for passing through a wall of the furnace for making electrical connection thereto, said terminal strip has a slot cut therein extending from the end of the terminal strip lengthwise thereof partially along the length thereof, said terminal slot is located in the end of the terminal strip which is welded to the end of said heating strip, said terminal slot has a length which is many times greater than the thickness of said terminal strip, and said terminal slot is aligned with one of the slots in said heating strip.

4. In an electric heating furnace, an improved heating element as claimed in claim 3, in which:

said heating element has an odd number of slots cut therein, and said terminal slot matches with the middle slot in said heating strip.

5. In an electric heating furnace including a hollow body having walls of refractory material defining a chamber for receiving material to be heated therein and wherein a heating element includes a heating strip of electrically conductive resistance material, said strip having thickness and having a width which is many times greater than its thickness for providing a heat radiating surface with corrugations therein extending transversely of the length of the strip and being mounted in the chamber spaced from a wall thereof with said radiating surface facing toward said chamber and includes a terminal having an end welded to an end of said heating strip and extending generally perpendicular to the radiating surface of said heating strip for passing through a wall of the furnace for conducting electrical current to said heating strip, an improved heating element in which:

said corrugated heating strip has a plurality of spaced parallel slots cut therein, each of said slots extending from the end of the heating strip in a direction lengthwise of the strip, said slots extending part of the way along the length of said heating strip and being located in the end of the heating strip to which said terminal is welded, said terminal has a slot in the end thereof which is welded to said heating strip, and said terminal slot extends lengthwise of said terminal and is aligned with one of the slots in said heating strip.

6. In an electric heating furnace, an improved heating element as claimed in claim 5, in which:

said terminal is a strip having a width similar to the width of said heating strip, and said terminal slot is located in the middle of the end of the terminal strip.

7. For use in an electrical heating furnace including a hollow body having walls of refractory material defining a chamber for receiving material to be heated therein, an improved electric resistance heating element comprising:

a pair of heating strips of electrically conductive resistance material, said heating strips being positioned in spaced parallel relationship and having heat radiating surfaces positioned in the same general plane with an edge of one heating strip facing toward an edge of the other heating strip, each of said heating strips having a width which is many times greater than its thickness, each of said heating strips having corrugations therein extending transversely of the length of the strip;

a pair of jumper strips of the same material as said heating strips, said jumper strips lying in said general plane and extending between said heating strips and extending transversely across a first end of each of said heating strips, said pair of jumper strips each being welded to said first end of each of said heating strips with said first end of each heating strip being sandwiched between said jumper strips;

a pair of terminals, one of said terminals being welded to a second end of a respective heating strip and extending generally perpendicular to said plane for being adapted to pass through a wall of the furnace for making electrical connection thereto;

each of said heating strips having a plurality of slots cut lengthwise therein extending from its first end perpendicular to said pair of jumper strips for reducing stresses where the jumper strips are welded to each heating strip; and each of said heating strips having a plurality of slots cut lengthwise therein extending from its second end perpendicular to the respective terminal welded thereto for reducing stresses where the terminal is welded to the respective heating strip.

8. For use in an electric heating furnace, an improved electric resistance heating element as claimed in claim 7, in which:

each of said terminals has a slot cut therein extending perpendicular to the second end of the heating strip welded thereto, said terminal slot being in the middle of said terminal and being aligned with one of the slots in the second end of the heating strip welded to said terminal.

* * * * *